US010584500B2

(12) United States Patent
Tann

(10) Patent No.: US 10,584,500 B2
(45) Date of Patent: Mar. 10, 2020

(54) ASSEMBLY FOR ACCESSING AN ELECTRONIC DISPLAY

(71) Applicant: John A Tann, Lenexa, KS (US)

(72) Inventor: John A Tann, Lenexa, KS (US)

( * ) Notice: Subject to any disclaimer, the term of this patent is extended or adjusted under 35 U.S.C. 154(b) by 157 days.

(21) Appl. No.: 15/614,848

(22) Filed: Jun. 6, 2017

(65) Prior Publication Data

US 2017/0350144 A1 Dec. 7, 2017

Related U.S. Application Data

(60) Provisional application No. 62/345,978, filed on Jun. 6, 2016.

(51) Int. Cl.

| | |
|---|---|
| ***E04G 1/20*** | (2006.01) |
| ***E04G 1/15*** | (2006.01) |
| ***E04G 5/14*** | (2006.01) |
| ***E04G 3/22*** | (2006.01) |
| *E04G 1/24* | (2006.01) |
| *E04G 3/28* | (2006.01) |

(52) U.S. Cl.

CPC ..... *E04G 1/20* (2013.01); *E04G 1/152* (2013.01); *E04G 3/22* (2013.01); *E04G 5/14* (2013.01); *E04G 2001/242* (2013.01); *E04G 2003/283* (2013.01)

(58) Field of Classification Search

CPC .. E04G 1/20; E04G 1/152; E04G 3/22; E04G 5/14; E04G 2001/242; E04G 2003/283

See application file for complete search history.

(56) References Cited

U.S. PATENT DOCUMENTS

| | | | | | |
|---|---|---|---|---|---|
| 1,423,998 | A * | 7/1922 | Camp | E04G 3/34 | 182/38 |
| 1,442,697 | A * | 1/1923 | Orthmann | E04G 3/22 | 182/129 |
| 3,124,213 | A * | 3/1964 | Jorsey | E01D 19/106 | 182/13 |
| 3,391,757 | A * | 7/1968 | Duke | E04G 3/34 | 182/17 |
| 3,491,851 | A * | 1/1970 | Dutcher | E04G 3/34 | 182/36 |

(Continued)

*Primary Examiner* — Katherine W Mitchell
*Assistant Examiner* — Candace L Bradford
(74) *Attorney, Agent, or Firm* — Hovey Williams LLP

(57) ABSTRACT

An assembly for installation, repair, or maintenance of balcony-mounted displays. The assembly may include a straddling component or frame, an anchoring assembly for selectively fixing one end of the straddling component in a desired location along the balcony, and a person-holding structure suspended from the balcony by another end of the straddling component. The straddling component may include forward vertical supports extending from the person-holding structure, horizontal supports attached to the forward vertical supports, and aftward vertical supports attached to the horizontal supports. Transport wheels may be rotatably attached to the aftward vertical supports, for rollable relocation of the platform relative to the balcony. The anchoring assembly may include both forward and aftward extension pieces attached to the aftward vertical supports and selectively adjusted to cooperatively fix the aftward vertical supports between a balcony wall and a heel-kick surface below the balcony seating.

16 Claims, 9 Drawing Sheets

(56) References Cited

U.S. PATENT DOCUMENTS

| | | | | | |
|---|---|---|---|---|---|
| 3,620,331 | A * | 11/1971 | Shaw | E04G 3/34 | 182/36 |
| 3,880,256 | A * | 4/1975 | Couris | B66B 9/02 | 182/136 |
| 4,029,173 | A * | 6/1977 | Wakabayashi | E04G 1/34 | 182/150 |
| 4,274,507 | A * | 6/1981 | Williams | E04G 3/34 | 182/12 |
| 4,276,957 | A * | 7/1981 | Kilgore | E04G 3/22 | 182/130 |
| 4,496,027 | A * | 1/1985 | Fisher | E04G 3/34 | 182/142 |
| 4,542,804 | A * | 9/1985 | Power | A62B 1/02 | 182/150 |
| 4,753,321 | A * | 6/1988 | Winslow | E04G 1/20 | 182/145 |
| 5,065,838 | A * | 11/1991 | Finley | E04G 3/34 | 182/142 |
| 6,227,553 | B1 * | 5/2001 | Palmer | A62B 35/0068 | 280/47.18 |
| 6,666,299 | B2 * | 12/2003 | Cole | E04G 3/24 | 182/145 |
| 8,596,414 | B1 * | 12/2013 | Lown | E04G 3/265 | 182/45 |
| 9,505,590 | B2 * | 11/2016 | Chen | B66C 23/205 | |
| 2006/0175130 | A1 * | 8/2006 | Riley | E04G 3/20 | 182/82 |
| 2017/0121985 | A1 * | 5/2017 | Brough | E04G 3/20 | |
| 2017/0284113 | A1 * | 10/2017 | Lim | B08B 3/024 | |
| 2017/0350144 | A1 * | 12/2017 | Tann | E04G 1/20 | |

* cited by examiner

ASSEMBLY FOR ACCESSING AN ELECTRONIC DISPLAY

RELATED APPLICATIONS

This non-provisional patent application claims priority benefit to a provisional patent application entitled "Assembly for Accessing an Electronic Display," U.S. Application No. 62/345,978, filed Jun. 6, 2016, incorporated by reference herein in its entirety.

BACKGROUND

LED ribbon board displays and other video displays and equipment are often installed in sports stadiums and other indoor and outdoor venues for displaying scores, statistics, advertisements, animations, promotions, and other information. Such video equipment are typically installed in a "ring" on an interior wall or other support so they can be easily viewed by nearly everyone at the venue. For example, in many bowl-shaped sports stadiums, such equipment is typically mounted on a wall between upper and lower decks of seating.

Although this mounting arrangement enhances the viewability of the equipment, it makes it difficult to access the equipment for routine maintenance and repairs. To access the equipment, large and expensive bucket trucks or other machines must be used and/or tall scaffolding must be assembled amid the seats below the displays. Bucket trucks are costly and often do not extend far enough to reach high-mounted LED ribbon board displays. Assembling and dissembling scaffolding is time-consuming and expensive and can damage seats and other objects below the equipment.

Thus there is a need for an improved assembly and method for providing maintenance and repair access to stadium or balcony-mounted board displays.

SUMMARY

The present invention solves the above-described problems and provides a distinct advance in the art of stadium LED ribbon board display installation, repair, and maintenance. One embodiment of the invention is an assembly for installation, repair, or maintenance of balcony-mounted displays. The assembly includes a straddling component with opposing distal ends, an anchor assembly attached at one of the distal ends of the straddling component, and a person-holding structure attached at another distal end of the straddling component. The straddling component may include a forward vertical support attached to the person-holding structure, a horizontal support attached substantially perpendicular to the forward vertical support, and an aftward vertical support attached substantially perpendicular to the horizontal support and attached to the anchoring assembly. The anchoring assembly may include a forward extension piece and an aftward extension piece. The forward extension piece may be attached to the aftward vertical support and may extend in a direction toward the forward vertical support. The forward extension piece have a forward engagement portion for selectively engaging with a wall or rail of a balcony. The aftward extension piece may be attached to the aftward vertical support and may extend in a direction away from the forward vertical support. The aftward extension piece may have an aftward engagement portion for selectively engaging with a heel-kick surface of a stair or riser of the balcony. The engagement portions may be selectively actuatable toward and away from the aftward vertical support in order to selectively and cooperatively fix the aftward vertical support between the heel-kick surface and the wall or rail of the balcony.

In other embodiments of the invention, an assembly may include the straddling component, anchoring assembly, and person-holding structure described above and may further include transport wheels rotatably attached to the aftward vertical supports in order to support the aftward vertical supports above the balcony floor, enabling rollable relocation of the person-holding structure about the stadium balcony. Furthermore, the straddling component may include two of each of the forward vertical supports, horizontal supports, and aftward vertical supports, and the anchoring assembly may include two top forward extension pieces, two bottom forward extension pieces, and two aftward forward extension pieces.

In yet another embodiment of the invention, a method for accessing a display mounted on a fascia of a stadium balcony for maintenance, repair, replacement, or installation is presented. The method may be performed using an assembly having a straddling component having opposing distal ends, an anchoring assembly attached to one of the distal ends and a person-holding structure attached to another one of the distal ends. The stadium balcony may include a balcony floor, a stair or riser extending upward from the balcony floor and defining a heel-kick surface, and a balcony wall or balcony rail along an edge of the stadium balcony. The method may include the step of bracing the anchoring assembly between the heel-kick surface and at least one of the balcony wall and the balcony rail by expanding the anchoring assembly or otherwise extending extension pieces of the anchoring assembly. Next, the method may include the steps of orienting one or more horizontal supports of the straddling component on aftward vertical supports to extend over the balcony floor, then sliding forward vertical supports into vertical sleeves attached to or formed into the horizontal supports. The method may then include the steps of attaching the person-holding structure to a first one of the forward vertical supports below the sleeve and rotating the horizontal supports about the aftward vertical supports until the forward vertical supports and the person-holding structure extend outward from the balcony. The method may also include a step of sliding the forward vertical supports within the sleeves downward, thereby lowering the person-holding structure, until the person-holding structure is located at or below a height at which the display is mounted on the balcony. Once the person-holding structure is at a desired height, the method may include a step of attaching the person-holding structure to a second one of the forward vertical supports.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the present invention will be apparent from the following detailed description of the embodiments and the accompanying drawing figures.

BRIEF DESCRIPTION OF THE DRAWING FIGURES

Embodiments of the present invention are described in detail below with reference to the attached drawing figures, wherein.

Figure 1:
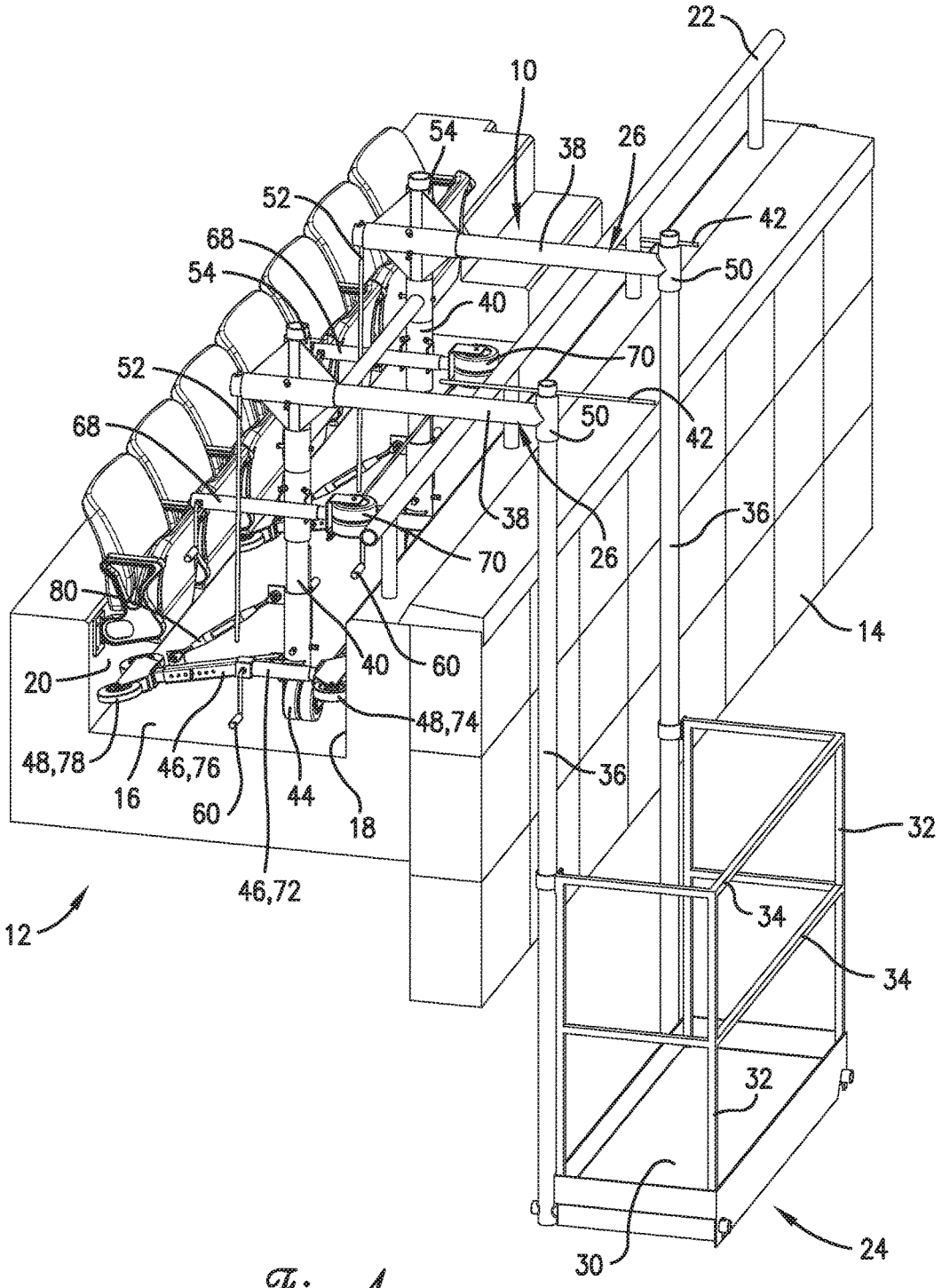
FIG. 1 is a front perspective view of a balcony-attaching assembly constructed in accordance with embodiments of the present invention, as installed onto a balcony.

The drawing figures do not limit the present invention to the specific embodiments disclosed and described herein. The drawings are not necessarily to scale, emphasis instead being placed upon clearly illustrating the principles of the invention.

DETAILED DESCRIPTION

The following detailed description of the invention references the accompanying drawings that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The following detailed description is, therefore, not to be taken in a limiting sense. The scope of the present invention is defined only by the appended claims, along with the full scope of equivalents to which such claims are entitled.

In this description, references to "one embodiment", "an embodiment", or "embodiments" mean that the feature or features being referred to are included in at least one embodiment of the technology. Separate references to "one embodiment", "an embodiment", or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the present technology can include a variety of combinations and/or integrations of the embodiments described herein.

Embodiments of the present invention are illustrated in FIGS. 1-8 and include an assembly 10 constructed according to embodiments of the present invention. The assembly 10 is attachable to a balcony 12 and configured to allow a maintenance person to safely and conveniently access, maintain, and repair video displays 14, such as LED ribbon board displays or other video displays and equipment attached to an edge of a stadium balcony or upper deck. The assembly 10 may specifically be configured to engage with and/or travel along a balcony floor 16, a balcony wall 18, a balcony heel-kick surface 20, and/or a balcony rail 22. The balcony heel-kick surface 20 may be a surface on a stair or riser of the balcony, often below stadium or balcony seating, as illustrated in FIG. 1.

The assembly 10 broadly comprises a straddling component 26 having opposing distal ends, an anchoring assembly 28 attached to one of the distal ends of the straddling component, and a person-holding structure 24 attached to another of the distal ends of the straddling component 26. The straddling component 26 may straddle the balcony wall 18 and/or the balcony rail 22, and the anchoring assembly 28 may securely anchor the straddling component to the balcony 12, thus cantilevering the person-holding structure 24 over the balcony wall 18 and/or rail 22 to support a person adjacent the balcony wall 18 and/or the displays 14 thereon. Embodiments of each of these components are described in more detail below.

The straddling component 26 may be any structure that suspends and supports the person-holding structure 24 adjacent the balcony wall 18. For example, the straddling component 26 may include forward vertical supports 36, horizontal supports 38 attached to the forward vertical supports 36, and aftward vertical supports 40 attached to the horizontal supports 38. The components of the straddling component 26 may be made of steel or any other suitable metals or substantially rigid materials and may be connected by welding, bolts, or any other fasteners. In some embodiments of the invention, the forward vertical supports 36 may be longer than the aftward vertical supports 40 and/or be positionable to extend downward from the horizontal supports 38 a greater distance than the aftward vertical supports 40.

The forward vertical supports 36 may comprise at least one or two substantially vertical, elongated rigid components attached to the person-holding structure 24. The forward vertical supports 36 may include, for example, pipes, posts, cylinders, rods, or rails to which the person-holding structure 24 may be mechanically connected. To allow for ease of assembly and lowering or raising of the person-holding structure 24, a T-bar, a horizontal rod 42, or other such gripping components may extend through and/or extend perpendicularly outward from the forward vertical supports 36, as later described herein. The horizontal rod 42 may also serve as a stopper to prevent the forward vertical supports 36 from detaching from the horizontal supports 38, as later described herein.

The horizontal supports 38 may comprise at least one or two substantially horizontal, elongated rigid components attached to the forward vertical supports 36 and attached to the aftward vertical supports 40. The horizontal supports 38 may include, for example, pipes, posts, cylinders, rods, or rails to which the forward and aftward vertical supports 36,40 may be connected. To allow for ease of assembly, the horizontal supports 38 may also comprise rigid forward sleeves 50 attached thereto or integrally-formed therewith. The forward sleeves 50 may be substantially vertically-oriented and sized and shaped to receive the forward vertical supports 36 therein, allowing the forward vertical supports 36 to slide therein for raising and lowering the person-holding structure 24 toward and away from the horizontal supports 38. To allow for ease of pivoting the horizontal supports 38 over the balcony 12 and outward away from the balcony 12, a T-bar, a vertical rod 52, or other such gripping components may extend through and/or extend perpendicularly downward from the horizontal supports 38.

The aftward vertical supports 40 may comprise at least one or two substantially vertical, elongated rigid components attached to the horizontal supports 38. The aftward vertical supports 40 may include, for example, pipes, posts, cylinders, rods, or rails which may be mechanically connected. In some embodiments of the invention, one or more stabilizing supports may extend between two aftward vertical supports 40 to provide added stability to the assembly 10. To allow for ease of assembly, each of the horizontal supports 38 may be rotatably attached to one of the aftward vertical supports 40 and may be configured to selectively rotate about a vertical axis of the aftward vertical supports 40. For example, a vertical pivot protrusion or aftward sleeve 54 may be fixedly attached to and extend vertically from at least one of the horizontal supports 38 and may be slid onto one of the aftward vertical supports 40 or slid at least partially into an opening of one of the aftward vertical supports 40. Attached in this configuration, the horizontal supports 38 may be selectively pivoted from a first orientation (e.g., over the balcony 12) to a desired second orientation (e.g., extending outward past an edge of the balcony 12) and then locked into that second orientation. In some embodiments of the invention, transport wheels 44 may additionally be attached to ends of the aftward vertical supports 40, allowing rolling movement of the assembly 10 on the balcony floor 16 about an inner rim or edge of the balcony 12.

The anchoring assembly 28 may comprise a plurality of extension pieces 46 configured for actuation toward and away from the aftward vertical supports 40. For example, the extension pieces 46 may include one or more rails, posts, frame structures, cylinders, rods, pipes, or the like and may each be actuatably attached to one of the aftward vertical supports 40. The extension pieces 46 may configured to telescope, retract, fold, rotate, and/or pivot toward and away from the aftward vertical supports 40. This may be accomplished via actuation components such as pivots, pistons, telescoping assemblies, or other mechanical actuation tools and configurations known in the art. In one exemplary embodiment of the invention, one or more of the extension pieces 46 may include a first component 56 fixedly or pivotally attached to one of the aftward vertical supports 40 and a second component 58 slidably-connected with the first component 56, either by fitting inside of the first component 56 or being sized such that it can slide over and onto the first component 56. In some embodiments of the invention, a crank arm 60 or the like may be used to selectively retract or extend the second component 58 toward or away from the aftward vertical supports 40. Other automated and/or manual actuation of the second component 58 relative to the first component 56 may also be used without departing from the scope of the invention.

Furthermore, various locking devices 62 may be used to lock the second component 58 and/or the first component 56 at a desired amount of extension or retraction or at a desired pivoting angle. In one exemplary embodiment of the invention, the first component 56 and/or the second component 58 may have a plurality of holes 64 formed through at least one of its walls in spaced-apart intervals along a length of the first component 56 and/or the second component 58. Likewise, the first component 56 or the second component 58 may include a spring-loaded pin or another resilient protrusion 66 sized and shaped to engage with any or all of the holes 64 of the first and/or the second component 56,58. For example, the first component 56 may include the spaced-apart holes 64 along a length thereof, and the second component 58 may be sized and shaped to slide into the first component 56 when the resilient protrusion 66 is compressed toward the second component 58. When the resilient protrusion 66 aligns with one of the holes 64 of the first component 56, the resilient protrusion 66 springs back to its naturally-biased position, such that the first and the second components 56,58 are selectively locked together at that point. To slide the second component 58 again, an operator may push the resilient protrusion 66 back through the hole 64 and slide the second component 58 toward or away from the first component 56 until the resilient protrusion 66 encounters another one of the holes 64.

The extension pieces 46 may have engagement portions 48 integrally formed therewith or otherwise attached thereto at distal ends thereof. The engagement portions 48 may be configured for riding along or abutting against the balcony wall 18, balcony heel-kick surface 20, and/or balcony rail 22. In some embodiments of the invention, the engagement portions 48 may include engagement wheels, blocks, pads, or other elements configured to rotatably and/or slidably ride along or abut against a rigid surface such as a wall or rail. When extended sufficiently, the extension pieces 46, via the engagement portions 48, may brace or lock the aftward vertical supports 40 into a fixed position between the heel-kick surface 20 and the balcony wall 18 or balcony rail 22 to prevent actuation or undesired movement of the assembly 10 when the person-holding structure 24 is occupied. In some embodiments of the invention, one or more of the engagement portions 48 may be configured to retract and/or pivot toward and away from one of the aftward vertical supports 40 sufficiently to provide additional clearance that may be needed for obstacles in its path about the edge of the balcony 12, such as stadium stairs between seats or the like.

In some embodiments of the invention, the extension pieces 46 may include one or more top forward extension pieces 68 with top forward engagement portions 70, one or more bottom forward extension pieces 72 with bottom forward engagement portions 74, and aftward extension pieces 76 with aftward engagement portions 78. The top forward engagement portions 70 may be configured to selectively engage with the balcony rail 22, the bottom forward engagement portions 74 may be configured to selectively engage with the balcony wall 18, and the aftward engagement portions 78 may be configured to selectively engage with the heel-kick surface 20.

As illustrated in FIGS. 1-8, one or more of the aftward extension pieces 76 may be angled in a generally downward and aftward direction and may include telescoping and pivoting components, such that the aftward extension pieces 76 may telescope toward and away from the aftward vertical supports 40 for selectively engaging and disengaging with the heel-kick surface 20 and also may selectively pivot toward and away from the aftward vertical supports 40 in order to further retract to avoid obstacles such as stadium stairs while being transported about the balcony's edge. Mechanical locking mechanisms, such as the resilient protrusion 66 described above, may be utilized to manually or automatically selectively lock any of the extension pieces in their desired positions or orientations. Other stabilizing components or structural supports may be mechanically and/or integrally attached to components of the straddling component 26 or the anchoring assembly 28 without departing from the scope of the invention. For example, a turnbuckle 80 may be selectively attached at an angle between one of the aftward extension pieces 76 and one of the aftward vertical supports 40 to provide additional structural support. However, the turnbuckle 80 may also be unattached at at least one end as needed for repositioning of the assembly 10.

Note that the engagement portions 48 described herein may engage with other balcony surfaces for stabilization or transport purposes without departing from the scope of the invention. For example, if the balcony 12 has rails but no wall, the top forward engagement portions 70 and the bottom forward engagement portions 74 may be configured to engage with top and bottom rails thereof, respectively. Likewise, if the balcony 12 does not have the heel-kick surface 20 below seating thereof, other structural portions of balcony seating and/or stairs or risers may be used by the aftward engagement portions 78 for stabilization as described herein without departing from the scope of the invention.

The person-holding structure 24 may be a platform, as illustrated in FIGS. 1, 2, 6, and 7, or may alternatively be some sort of seat, person-holding bucket, or any structure sized, shaped, and configured for supporting the weight of one or more adult humans. The person-holding structure 24 may be constructed of wood, metal, plastic, composite materials, or any combination thereof and may be assembled by welding, bolts, or any other fasteners. In some embodiments of the invention, the person-holding structure 24 may be a platform sized and shaped to accommodate one person or several people. The platform may include a floor 30, one or more upstanding posts or rails 32 extending vertically from the floor 30, and one or more parallel posts or rails 34 attached to the upstanding posts or rails 32 and substantially parallel to the floor 30, the posts or rails 32,34 cooperatively forming an open-topped cage in which an operator may stand. The floor may be rectangular, square, or any shape, size, and configuration, and may include slip-resistant surfaces or textures applied thereto, to prevent a person therein from slipping. Note that any or all of the posts or rails 32,34 may be omitted or detached from the floor 30, as illustrated in FIG. 4, without departing from the scope of the invention.

Figure 4:
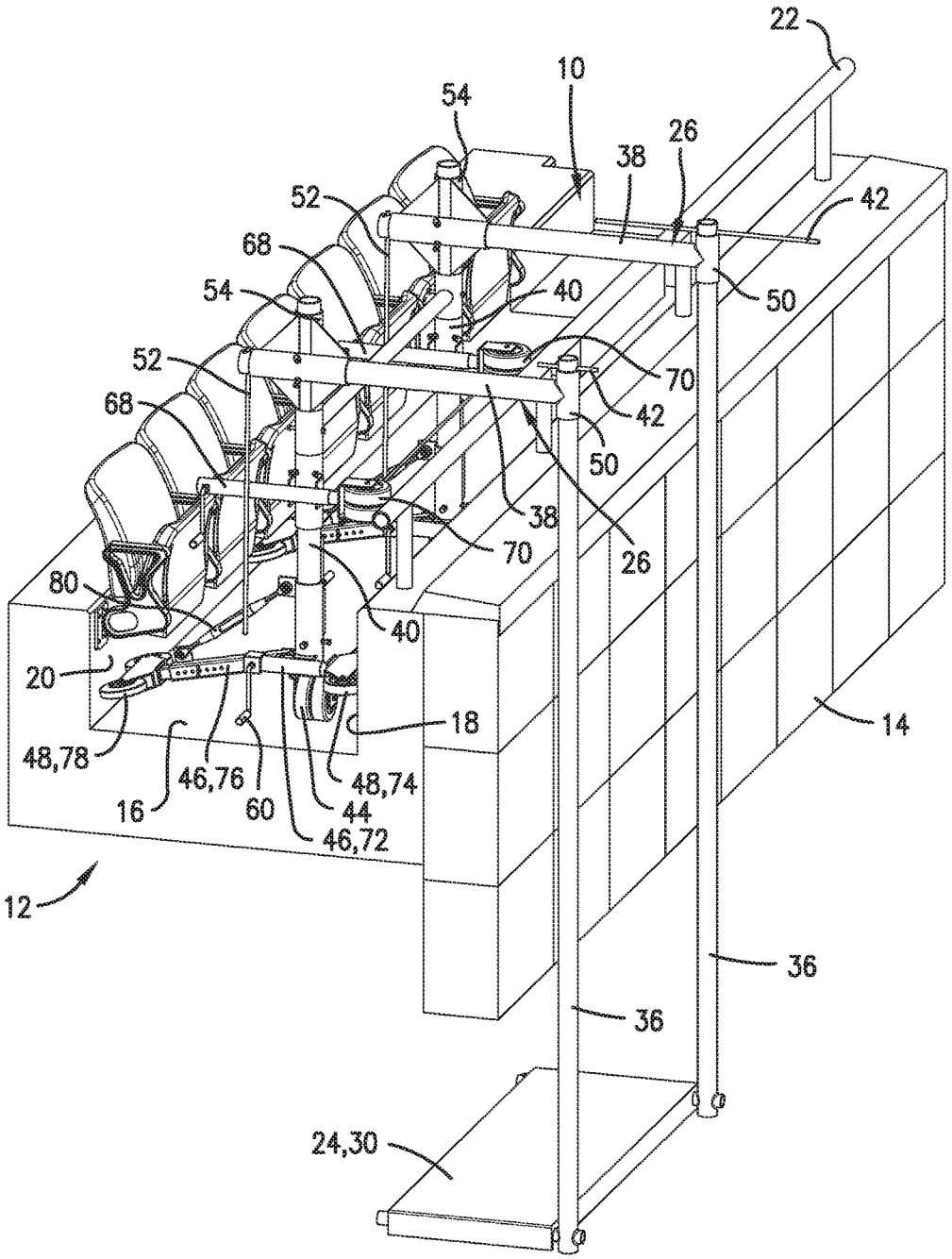
FIG. 4 is a front perspective view of the balcony-attaching assembly of FIG. 1 assembled in an alternative configuration, with rails removed from a platform thereof and the platform floor facing in an opposite direction.
Figure 5:
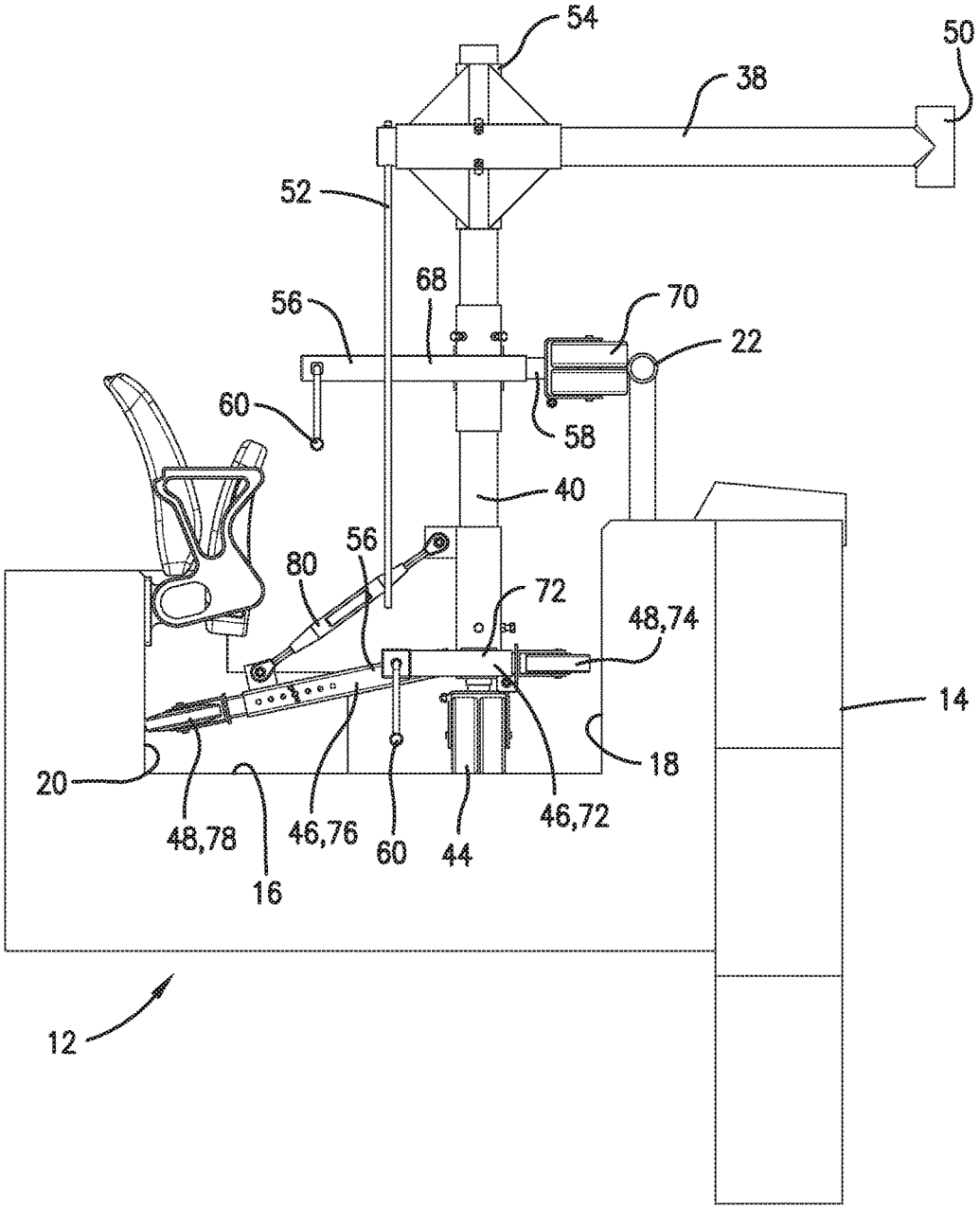
FIG. 5 is a side elevation view of the balcony-attaching assembly of FIG. 1 with extension pieces in a retracted configuration to allow the balcony-attaching assembly to freely travel along an edge of the balcony.
Figure 6:
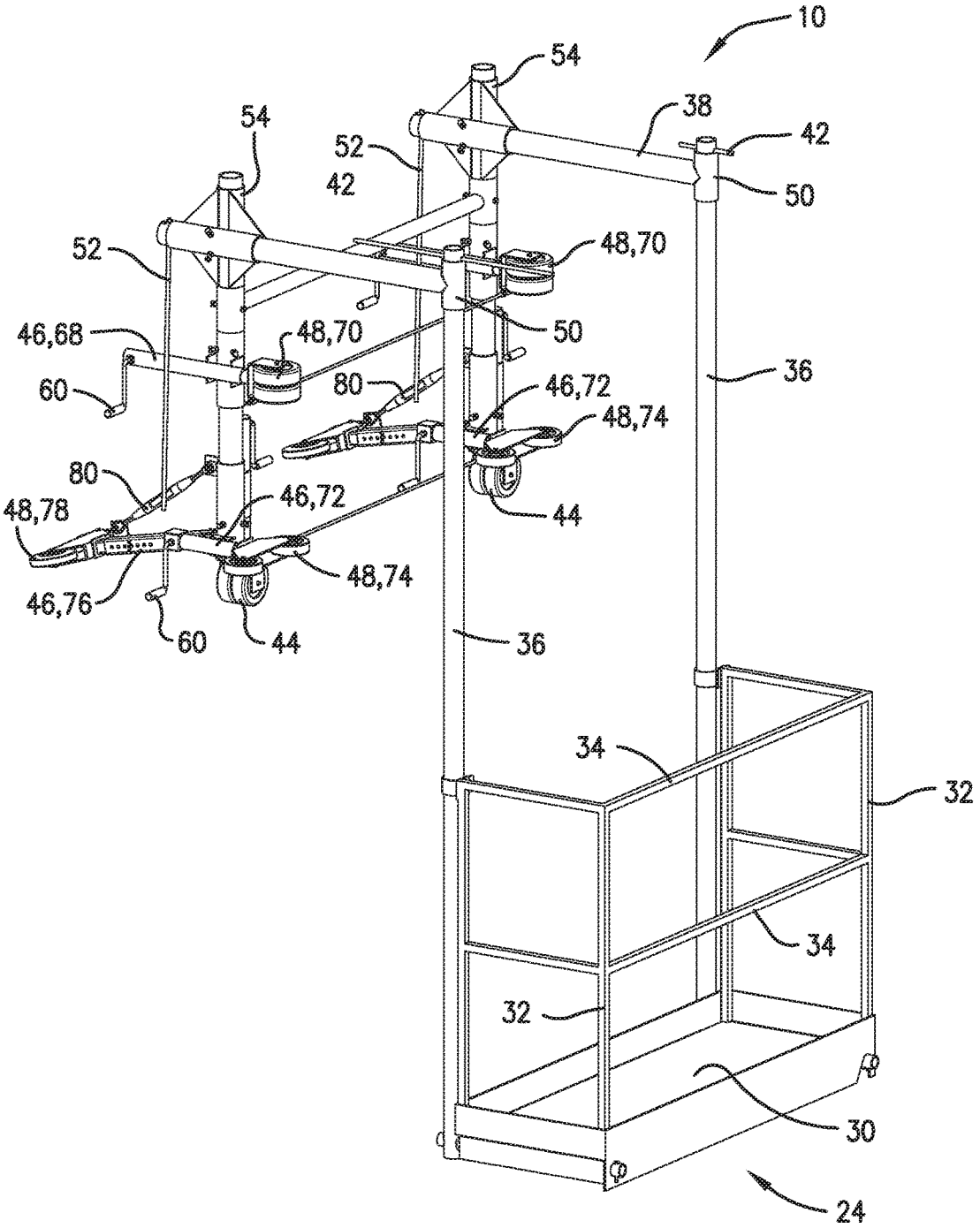
FIG. 6 is a front perspective view of the balcony-attaching assembly of FIG. 1 unattached to the balcony.
Figure 7:
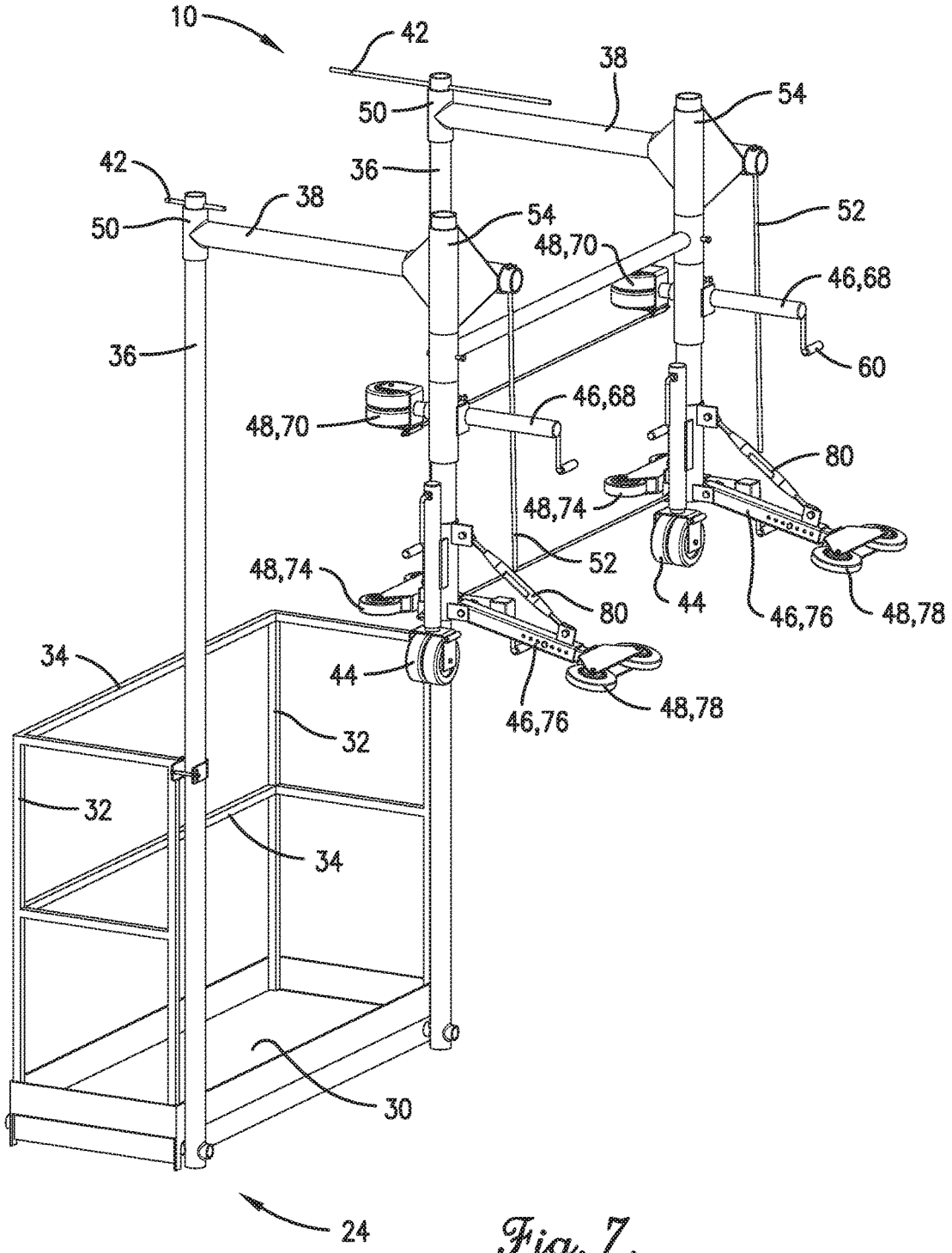
FIG. 7 is a rear perspective view of the balcony-attaching assembly of FIG. 1 unattached to the balcony.
Figure 8:
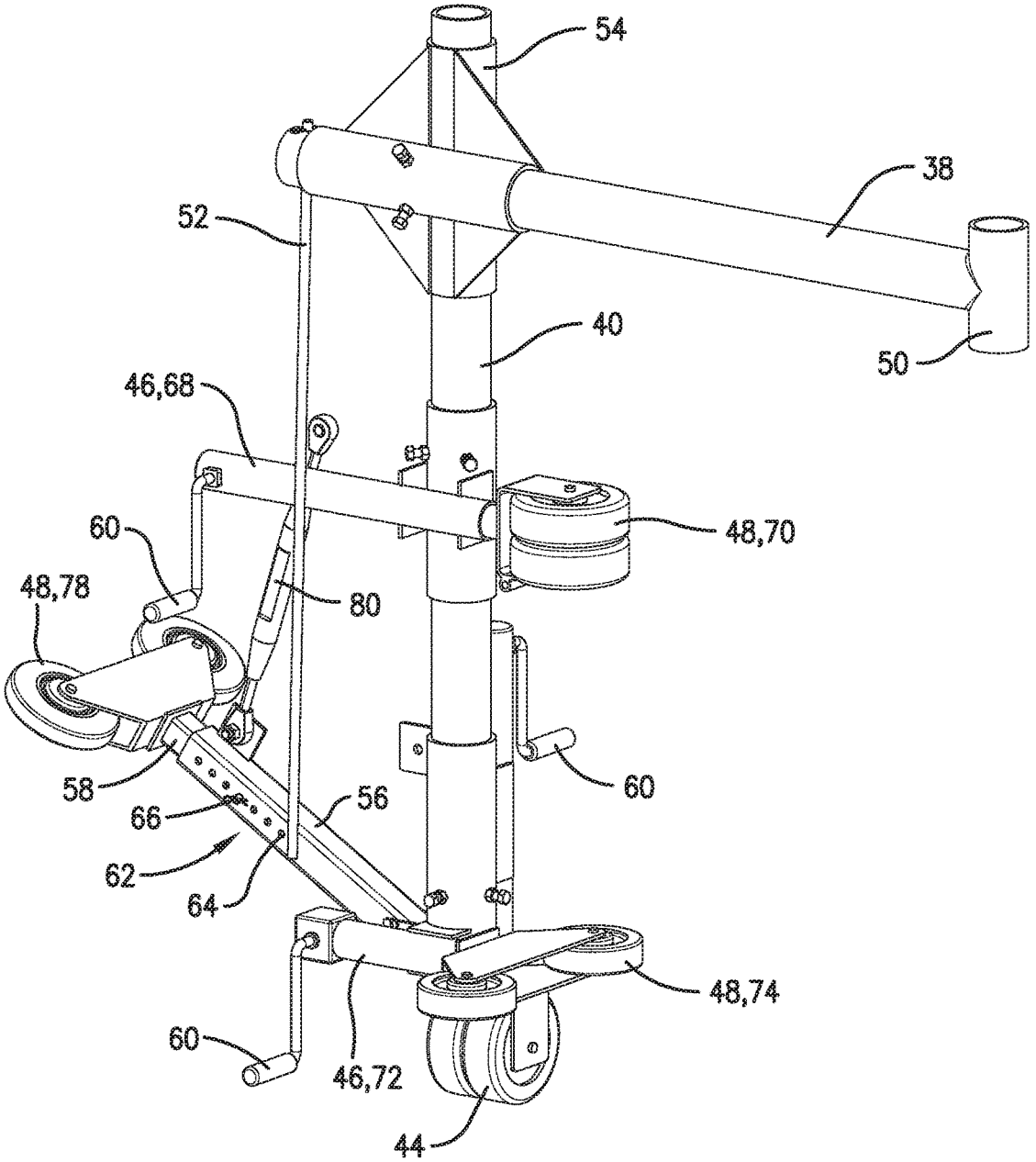
FIG. 8 is a front perspective view of a horizontal support and an aftward vertical support of the balcony-attaching assembly of FIG. 1 with an aftward extension piece rotated to avoid obstacles during travel.

In some embodiments of the invention, the person-holding structure 24 may be detachably connected to one or two of the forward vertical supports 36 and may be configured to rotate about an axis of at least one of the forward vertical supports 36 such that the floor 30 may extend from the forward vertical supports 36 in a direction toward the balcony 12 (allowing access underneath the displays 14), as depicted in FIG. 4, or away from the balcony 12 as illustrated in FIG. 1. For example, the rails 32,34 may be mechanically detached from the floor 30 and/or the forward vertical supports 36, and the floor 30 may be mechanically detached from one of the forward vertical supports 36 and then rotated approximately 180-degrees about the other of the forward vertical supports 36. Then the floor 30 may be mechanically re-attached such that both of the forward vertical supports 36 are fixedly supporting the floor 30 beneath the balcony 12 and/or the displays 14. Alternatively, the floor 30 may be configured to be completely detached from a first orientation facing away from the balcony 12 and reattached at a second orientation facing toward the balcony 12.

In use, the assembly 10 may be transported to a desired location on the balcony 12 and then the extension pieces 46 of the assembly 10 may be extended and locked in place in their extended positions such that the aftward vertical supports 40 are fixed at a location between the balcony wall 18 or rail 22 and the heel-kick surface. Next, the assembly 10 may be partially assembled over the balcony floor 16 and/or stadium seats, and the horizontal supports 38 may be rotated to partially extend outward from the balcony 12. Then the person-holding structure 24 may be lowered a desired amount required to reach the displays 14 and a person in any sort of harness secured to the balcony 12 or a structure fixed to the balcony 12 may be lowered to the person-holding structure 24 to secure any remaining unsecured portions of the person-holding structure 24 to one or more of the forward vertical supports 36. The person may then lay, sit, or stand on the person-holding structure 24 and perform repair, maintenance, installation, and/or replacement of the displays 14, signage, or other items mounted over an edge of the balcony 12.

In order to reposition the assembly 10 at another point along the balcony 12, one or more of the extension pieces 46 may be retracted toward one of the aftward vertical supports 40 by a sufficient amount to allow the assembly 10 to roll along the balcony floor 16 via the transport wheels 44 without bracing or locking interference from the engagement portions 48. Furthermore, in some embodiments of the invention, the engagement portions 48 may be wheels or the like and may be retracted just enough to not lock the assembly 10 into place while still allowing the wheels to rotatably ride along the balcony rail 22, the balcony wall 18, and/or the heel-kick surface 20. The aftward extension pieces 76 may additionally be pivoted upward by a sufficient amount to avoid running into balcony steps or other obstacles along the heel-kick surface 20.

Figure 9:
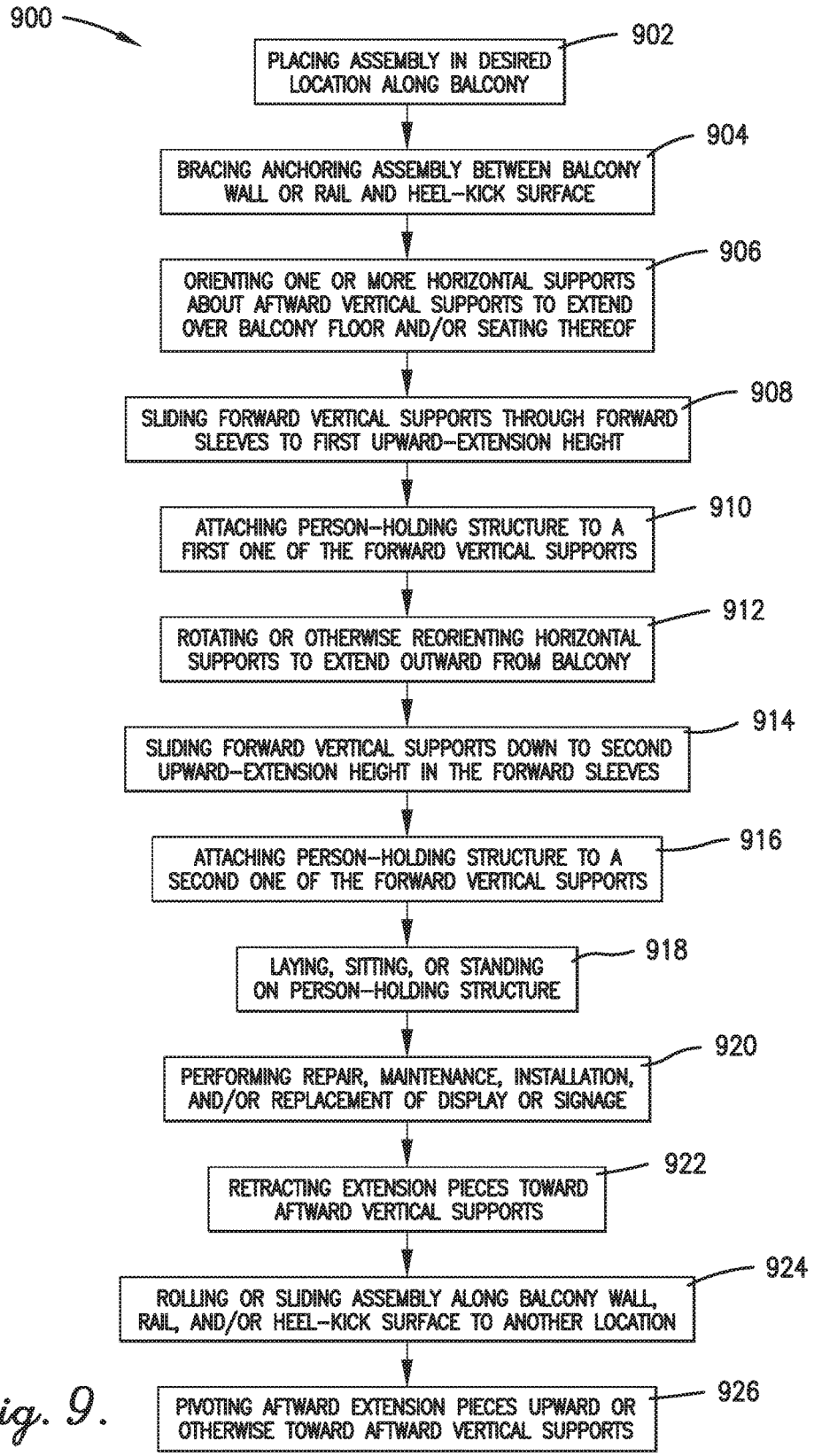
FIG. 9 is a flow chart depicting steps in a method of assembling and using the balcony-attaching assembly of FIG. 1 in accordance with an embodiment of the present invention.

Method steps for assembling, installing, and using the assembly 10 will now be described in more detail, in accordance with various embodiments of the present invention. The steps of the method 900 may be performed in the order as shown in FIG. 9, or they may be performed in a different order. Furthermore, some steps may be performed concurrently as opposed to sequentially. In addition, some steps may not be performed.

Figure 2:
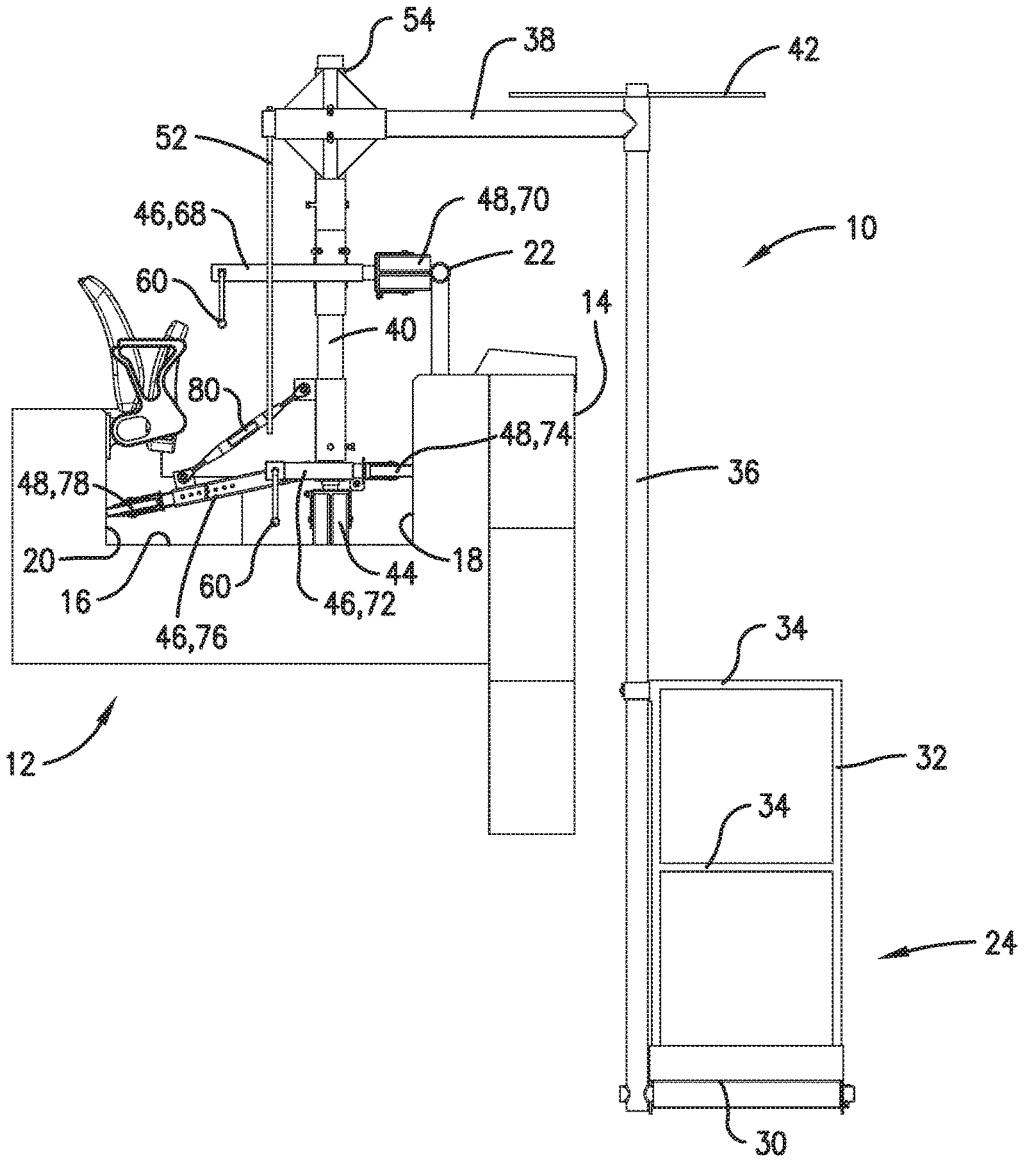
FIG. 2 is a side elevation view of the balcony-attaching assembly of FIG. 1.
Figure 3:
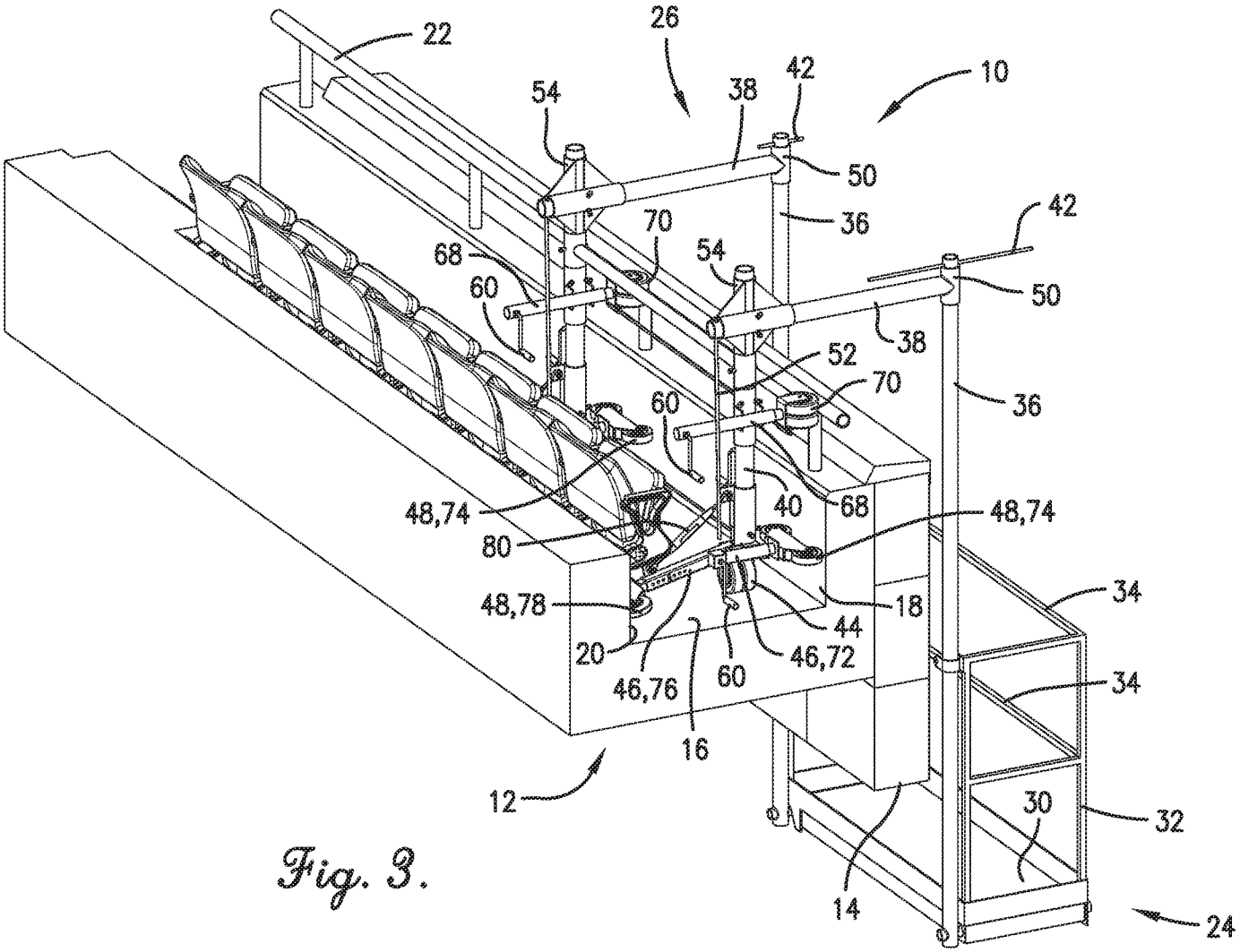
FIG. 3 is a rear perspective view of the balcony-attaching assembly of FIG. 1

The method 900 may first include a step of placing the assembly 10 in a desired location along the balcony 12, as depicted in block 902, and bracing the anchoring assembly 28 between the balcony wall 18 or rail 22 and the heel-kick surface 20, as depicted in block 904 and FIGS. 1-2. Specifically, this bracing or locking may be performed by extending the extension pieces 46 into a maximum extension orientation, such that the aftward vertical supports 40 are thereby fixed at a location between the balcony wall 18 or rail 22 and the heel-kick surface 20. For example, the assembly 10 may be wheeled on the transport wheels 44 to a desired location along the balcony 12 and then the aftward extension pieces 76 may be extended aftward, pressing the aftward engagement portions 78 against the heel-kick surface 20, and the forward extension pieces 68,72 may be extended forward, pressing the forward engagement portions 70,74 against the balcony wall 18 and/or rails 22. The opposing forces exerted by the aftward extension pieces 76 and the forward extension pieces 68,72 thus substantially lock the assembly 10 into place on the balcony 12. As noted above, the extension pieces 46 may be extended via pivoting, telescoping, and/or other manual or automated methods described herein or known in the art.

Next, the method 900 may include a step of orienting one or more of the horizontal supports 36 about the aftward vertical supports 40 to extend over the balcony floor 16 and/or seating attached to or resting on the balcony floor 16, as depicted in block 906. This may be the first starting position of the assembly 10. However, if the horizontal supports 36 must be reoriented, the vertical rods 52, horizontal rods 42, or other grippable surfaces may be gripped by one or more persons and pushed or pulled in order to rotate or pivot the horizontal supports 38 relative to the aftward vertical supports 40.

The method 900 may then include the steps of sliding the forward vertical supports 36 through the forward sleeves 50 to a first upward-extension height, as depicted in block 908, and attaching the person-holding structure 24 to a portion of a first one of the forward vertical supports 36 extending below the forward sleeve 50, as depicted in block 910. This allows easy attachment of at least one end of the person-holding structure 24 prior to extending the person-holding structure 24 outward of the balcony 12.

Next, the method 900 may include the steps of rotating or otherwise reorienting the horizontal supports 38 to extend outward from the balcony 12, as depicted in block 912, and then sliding the forward vertical supports 36 within the forward sleeves 50 down to a second upward-extension height, as depicted in block 914, thereby lowering the person-holding structure 24 to a desired position relative to the display 14 mounted on the balcony 12. The second upward extension height may be determined based on where the horizontal rod 42 is located on the forward vertical supports 36. The horizontal rods 42 may thus operate as stoppers to prevent the forward vertical supports 36 from sliding more than desired and/or sliding out of the forward sleeves 50. However, other mechanical devices for holding the forward vertical supports 36 relative to the forward sleeves 50 may be used without departing from the scope of the invention.

Next, the method 900 may include a step of attaching the person-holding structure 24 to a second one of the forward vertical supports 36, as depicted in block 916. This may be performed by a person in any sort of harness secured to the balcony 12 or a structure fixed to the balcony 12. The person may be lowered to the person-holding structure 24 to secure any remaining unsecured portions of the person-holding structure 24 to one of the forward vertical supports 36. The manner in which the first one of the forward vertical supports 36 is attached to the person-holding structure 24 may dictate a configuration of the person-holding structure. For example, in some embodiments of the invention, the floor 30 or platform of the person-holding structure 24 may be reconfigurable to either extend in a direction away from the balcony 12 or to extend in a direction toward the balcony 12 such that a person may have access to an underside of the display 14. In some embodiments of the invention, the floor 30 without the rails 32 may be rotated on the first or the second one of the forward vertical supports 36 so as to extend under a fascia of the balcony 12 to provide better access to the underside of the display 14 or video equipment mounted to the balcony 12.

Following step 916, the assembly 10 is thus assembled and locked into place for use. The method 900 may then include the steps of the person laying, sitting, or standing on the person-holding structure 24, as depicted in block 918, and performing repair, maintenance, installation, and/or replacement of the displays 14, signage, or other items mounted over the edge of the balcony 12, as depicted in block 920.

In some embodiments of the invention, the method 900 may further comprise a step of retracting at least one of the extension pieces 46 toward one of the aftward vertical supports 40, as depicted in block 922, and rolling or sliding the assembly 10 along the balcony wall 18, the balcony rail 22, and/or the heel-kick surface 20 to another location on the balcony 12, as depicted in block 924. This retraction may be performed via pivoting, telescoping, or the like as described above. The extension pieces 46 may be retracted by a sufficient amount to allow the assembly 10 to roll along the balcony floor 16 via the transport wheels 44 without interference from the engagement portions 48. Furthermore, this allows for multiple repairs without requiring disassembling and reassembling the assembly 10 and without requiring lifting of heavy equipment from one location to another location on the balcony 12.

Specifically, if the engagement portions 48 are wheels or the like, some or all of the extension pieces 46 may be retracted by a small amount, just enough to not lock the assembly 10 into place while still allowing the wheels to rotatably ride along the balcony rail 22, the balcony wall 18, and/or the heel-kick surface 20. In some embodiments of the invention, the method 900 may further include pivoting the aftward extension pieces 76 upward or otherwise toward the aftward vertical supports 40 by a sufficient amount to avoid running into balcony steps or other obstacles along the heel-kick surface 20, as depicted in block 926. Similar pivoting capabilities may also be provided to the forward extension pieces 68,72 for avoiding wall or rail obstacles without departing from the scope of the invention.

Although the invention has been described with reference to the embodiments illustrated in the attached drawing figures, it is noted that equivalents may be employed and substitutions made herein without departing from the scope of the invention as recited herein. For example, although manual crank arms and resilient protrusions are shown for actuation and locking in place of various components herein, other mechanical, hydromechanical, or electromechanical actuation and/or locking devices and arrangements may be used without departing from the scope of the invention. For example, the telescoping described herein may be performed via hydraulic pistons. Likewise, a winch system or the like may be used to raise and/or lower the forward vertical supports 36. Furthermore, any method steps herein described as being performed manually by a person may alternatively be performed by automated devices without departing from the scope of the invention.

Having thus described one or more embodiments of the invention, what is claimed as new and desired to be protected by Letters Patent includes the following:

The invention claimed is:

1. An assembly for installation, repair, or maintenance of displays mounted on a fascia of a balcony, the assembly comprising:

a straddling component configured for straddling at least one of a wall of the balcony and a rail of the balcony, the straddling component comprising:

at least one forward vertical support, at least one horizontal support attached substantially perpendicular to the forward vertical support, and at least one aftward vertical support attached substantially perpendicular to the horizontal support;

an anchoring assembly attached to the aftward vertical support, the anchoring assembly comprising:

at least one forward extension piece attached to the aftward vertical support and extending in a direction toward the forward vertical support, the forward extension piece having at least one forward engagement portion configured to selectively engage with the wall or the rail of the balcony; and at least one aftward extension piece attached to the aftward vertical support and extending in a direction away from the forward vertical support, the aftward extension piece having at least one aftward engagement portion configured to selectively and horizontally engage with a heel-kick surface of a stair or riser of the balcony, wherein at least one of the engagement portions is selectively actuatable toward and away from the aftward vertical support in order to selectively and cooperatively fix the aftward vertical support in place between the heel-kick surface and the wall or rail of the balcony; and a person-holding structure attached to the forward vertical support and configured to support at least one person thereon.

2. The assembly of claim 1, wherein at least one of the forward engagement portions and the aftward engagement portions includes a rotatable wheel, a slidable pad, or a slidable block configured to engage with at least one of the heel-kick surface, the wall, or the rail of the balcony.

3. The assembly of claim 1, wherein at least a portion of the aftward extension piece is configured to pivot relative to the aftward vertical support during transport to avoid obstacles along the heel-kick surface.

4. The assembly of claim 1, wherein at least a portion of the aftward extension piece is configured to telescope toward and away from the aftward vertical support.

5. The assembly of claim 1, wherein at least a portion of the forward extension piece is configured to selectively telescope toward and away from the aftward vertical support.

6. The assembly of claim 1, wherein the person-holding structure is selectively actuatable relative to the forward vertical support, such that the person-holding structure is reconfigurable from a first position extending away from the aftward vertical support to a second position extending toward the aftward vertical support.

7. The assembly of claim 1, wherein the forward vertical support is actuatable relative to the horizontal support, adjusting a distance between the person-holding structure and the horizontal support.

8. The assembly of claim 1, wherein the person-holding structure is a platform including a floor, one or more upstanding posts or rails extending vertically from the floor, and one or more parallel posts or rails attached to the upstanding posts or rails and substantially parallel to the floor.

9. The assembly of claim 1, further comprising one or more transport wheels rotatably attached to the aftward vertical support and configured to support the aftward vertical support above a floor of a balcony, enabling rollable relocation of the person-holding structure relative to the balcony.

10. An assembly for installation, repair, or maintenance of video or lighted displays mounted on a fascia of a stadium balcony, the stadium balcony including a balcony floor, at least one stair or riser extending upward from the balcony floor and defining a substantially vertical heel-kick surface, and at least one balcony wall or balcony rail along an edge of the stadium balcony, the assembly comprising:

a straddling component for straddling at least one of the balcony wall and the balcony rail, the straddling component comprising:

two forward vertical supports, two horizontal supports each having a first end and a second end, wherein the horizontal supports are attached substantially perpendicular to the forward vertical supports at locations proximate to the first ends of the horizontal supports, and two aftward vertical supports attached substantially perpendicular to the horizontal supports at a location proximate to the second ends of the horizontal supports;

transport wheels rotatably attached to the aftward vertical supports and configured to support the aftward vertical supports above the balcony floor, enabling rollable relocation of the straddling component about the stadium balcony;

an anchoring assembly attached to the aftward vertical supports, the anchoring assembly comprising:

two top forward extension pieces each attached to one of the aftward vertical supports and extending in a direction toward the forward vertical supports, each of the top forward extension pieces having at least one top forward engagement portion configured to selectively engage with an upper portion of the wall or the rail of the balcony, wherein the top forward engagement portion includes a rotatable wheel, a slidable pad, or a slidable block;

two bottom forward extension pieces attached to one of the aftward vertical supports and extending in a direction toward the forward vertical supports, each of the bottom forward extension pieces having at least one bottom forward engagement portion configured to selectively engage with a lower portion of the wall or the rail of the balcony, wherein the bottom forward engagement portion includes a rotatable wheel, a slidable pad, or a slidable block; and two aftward extension pieces each attached to one of the aftward vertical supports and extending in a direction away from the forward vertical supports, wherein each of the aftward extension pieces have at least one aftward engagement portion including a wheel rotatable about an at least partially vertically extending axis and configured to selectively and horizontally engage with a heel-kick surface of the stair or riser of the stadium balcony, wherein a portion of at least one of the extension pieces is selectively actuatable toward and away from the aftward vertical supports, selectively locking and unlocking the aftward vertical supports in place between the heel-kick surface and the wall or the rail of the balcony; and a person-holding structure attached to the forward vertical supports and configured to support at least one person thereon.

11. The assembly of claim 10, wherein a portion of at least one of the aftward extension pieces are configured to pivot relative to the aftward vertical supports and to be selectively locked in more than one pivoted position.

12. The assembly of claim 10, wherein a portion of at least one of the aftward extension pieces are configured to telescope toward and away from the aftward vertical supports and to be selectively locked in more than one telescoped position.

13. The assembly of claim 10, wherein at least a portion of least one of the top forward extension pieces and the bottom forward extension pieces are configured to selectively telescope toward and away from the aftward vertical supports and to be selectively locked in more than one telescoped position.

14. The assembly of claim 10, wherein the person-holding structure includes a platform selectively rotatable about at least one of the forward vertical supports, such that the platform is repositionable from a first position extending away from the aftward vertical supports to a second position extending toward the aftward vertical supports.

15. The assembly of claim 14, wherein the forward vertical supports are actuatable relative to the horizontal supports, thereby adjusting a distance between the platform and the horizontal supports.

16. The assembly of claim 14, wherein the platform includes a floor, one or more upstanding posts or rails extending vertically from the floor, and one or more parallel posts or rails attached to the upstanding posts or rails and substantially parallel to the floor.

* * * * *